US011819065B2

(12) United States Patent
Cormack

(10) Patent No.: US 11,819,065 B2
(45) Date of Patent: Nov. 21, 2023

(54) FASTENER INTEGRATED WITH A FABRIC SPACER

(71) Applicant: Lululemon Athletica Canada Inc., Vancouver (CA)

(72) Inventor: Elizabeth Cormack, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 121 days.

(21) Appl. No.: 17/154,812

(22) Filed: Jan. 21, 2021

(65) Prior Publication Data

US 2021/0235778 A1 Aug. 5, 2021

Related U.S. Application Data

(60) Provisional application No. 62/968,816, filed on Jan. 31, 2020.

(51) Int. Cl.
*A41C 3/12* (2006.01)
*A44B 18/00* (2006.01)

(52) U.S. Cl.
CPC ..... *A41C 3/12* (2013.01); *A44B 18/0011* (2013.01)

(58) Field of Classification Search
CPC ..... A41C 3/13; A44B 13/0023
USPC ..... 450/82
See application file for complete search history.

(56) References Cited

U.S. PATENT DOCUMENTS

| | | | | |
|---|---|---|---|---|
| 3,577,609 | A * | 5/1971 | Gottfried | A44B 11/2584 24/678 |
| 10,561,206 | B2 * | 2/2020 | Utaka | A44B 13/0023 |
| 11,419,372 | B2 * | 8/2022 | Cheung | A41F 1/006 |
| 2002/0068506 | A1 * | 6/2002 | Devita | A41F 1/006 450/1 |
| 2009/0019936 | A1 | 8/2009 | Gut et al. | |
| 2012/0112899 | A1 * | 5/2012 | Hannon | B60C 23/0489 340/445 |
| 2012/0142253 | A1 * | 6/2012 | Javaid | A41C 3/04 450/80 |
| 2013/0019900 | A1 | 1/2013 | Ehrmann et al. | |
| 2013/0068147 | A1 * | 3/2013 | Cheung | A41F 1/00 112/475.08 |
| 2013/0199005 | A1 * | 8/2013 | Fung | A44B 13/0011 24/698.2 |
| 2019/0357636 | A1 * | 11/2019 | Utaka | F16B 45/00 |
| 2021/0112899 | A1 * | 4/2021 | Muhlenfeld | A41C 3/0014 |

FOREIGN PATENT DOCUMENTS

| | | |
|---|---|---|
| CH | 9181 | 4/1895 |
| CH | 264583 | 10/1949 |
| CN | 103238990 A | 8/2013 |

(Continued)

*Primary Examiner* — Timothy K Trieu

(57) ABSTRACT

Examples of a fastener integrated with a fabric spacer are disclosed. The fastener comprises a first part with a first fastening member that has an eyelet with a base secured to a top surface of a first tape. The bottom surface of the tape is bonded to a fabric spacer. The fastener further comprises a second part with a second fastening member that has a hooking end. The second fastening member is secured to a second fabric. The hooking end of the second fastening member is configured to releasably engage the eyelet of the first fastening member to bring close together the first part and the second part of the fastener.

6 Claims, 4 Drawing Sheets

(56) References Cited

FOREIGN PATENT DOCUMENTS

| | | | |
|---|---|---|---|
| CN | 206814960 | U | 12/2017 |
| CN | 206909794 | U | 1/2018 |
| CN | 206956355 | U | 2/2018 |
| CN | 207666338 | U | 7/2018 |

* cited by examiner

FIG. 1 – PRIOR ART

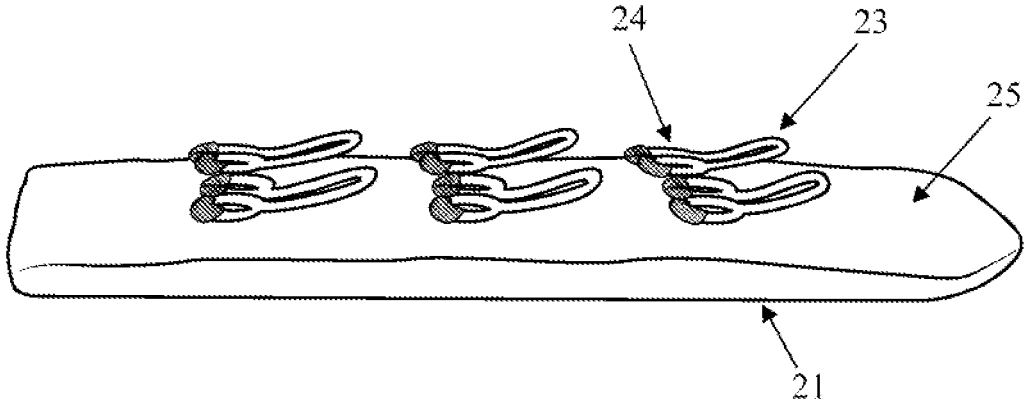
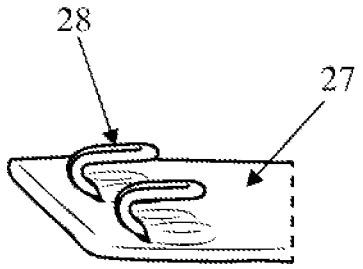
FIG. 3

FASTENER INTEGRATED WITH A FABRIC SPACER

TECHNICAL FIELD

The present disclosure relates to a fastener integrated with a fabric spacer cushion and more particularly relates to a three dimensional hook and eye fastener integrated with a fabric spacer cushion for releasably closing parts of a garment or accessory.

BACKGROUND

Hook and eye fasteners are a well known type of fastener. They comprise a hook part and an eye part, each sewn to one or more layers of a flat non-woven, nonbreathable fabric. Such traditional fastener can be rough on the skin of the wearer.

FIG. 1 schematically illustrates the hook and eye fastener 10 known in the prior art. The view on the right shows an eye part 11 with three rows of double eyelets 12 while the view on the left shows the hook part 16 with two hooks 18. Each of the eye part and the hook part comprises a pair of fastening members configured to engage each other. For example, the eyelet 12 comprises a loop 14 sized so that a hook end 19 of the hook 18 can engage with it keeping the two parts 11 and 16 close to each other. Each eyelet 12 has a base 13 that is secured to a tape 15 by, for example, stitching. Therefore, the base 13 of the eyelet 12 is secured to the tape 15 while the looping part 14 is free standing. The tape 15 can be one or more layers of fabric and can have a predetermined size. The fabric can be a tricot fabric or any other strong fabric. The eyelet 12 has a flat (two-dimensional) configuration with respect to a surface of the tape 15.

The hook 18 has a base that is similarly secured to another tape 17. The hook end 19 is free standing. The eyelet 12 and the hook 18 can be made of any suitable metal or plastic. The eyelet 12 and the hook 18 attached to respective tapes 15 and 17 can be integrated into a garment in order to releasably close part of the garment. As said herein above, the tape used in the fastener 10 must be made of a strong fabric in order to withstand the forces applied to it during the fastening and holding actions. However, such strong fabric in proximity to the skin of the wearer may cause discomfort and chafing to a wearer. In addition, the 2-D configuration of the eyelet 12 makes it harder for the wearer to fasten the hook end 19 to the flat hoop 14 of the eyelet 12. This may be prevented by using a thicker fabric or multiple layers of fabric, although this will make such a fastener heavy and aesthetically unattractive.

SUMMARY

In one aspect, a fastener integrated with a fabric spacer is provided. The fastener comprises a first part with a first fastening member that has a looping end with a base secured to a top surface of a first fabric. The first part further comprises a fabric spacer and a bottom surface of the first fabric is bonded to a top surface of the fabric spacer. The fastener further comprises a second part with a second fastening member that has a hooking end. The second fastening member is secured to a second fabric. The hooking end of the second fastening member is configured to releasably engage the looping end of the first fastening member to bring close together the first part and the second part of the fastener.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

FIG. 3 is a photograph of an example of a 3D eyelet integrated with a fabric spacer (view above) and an example of hook part similar to the one shown in FIG. 1.

DETAILED DESCRIPTION OF SPECIFIC EMBODIMENTS

The present invention discloses a fastener, such as a hook and eye fastener that is integrated with a fabric spacer for cushioning. The fabric spacer is a three-dimensional textile structure in which two outer fabric layers are connected with a spacer layer that extends therebetween. The spacer layer can be a monofilament layer that makes the fabric spacer soft and breathable. The fabric spacer can be manufactured by knitting or weaving and the three layers of the fabric spacer are knitted/woven as one cohesive fabric, such that there is no bonding, gluing or laminating of the layers. The properties of the fabric spacer can be changed by using different monofilament(s) as well as different outer layer(s). For example, the fabric spacer can have an anti-bacterial finishing and/or can be water resistant.

Figure 1:
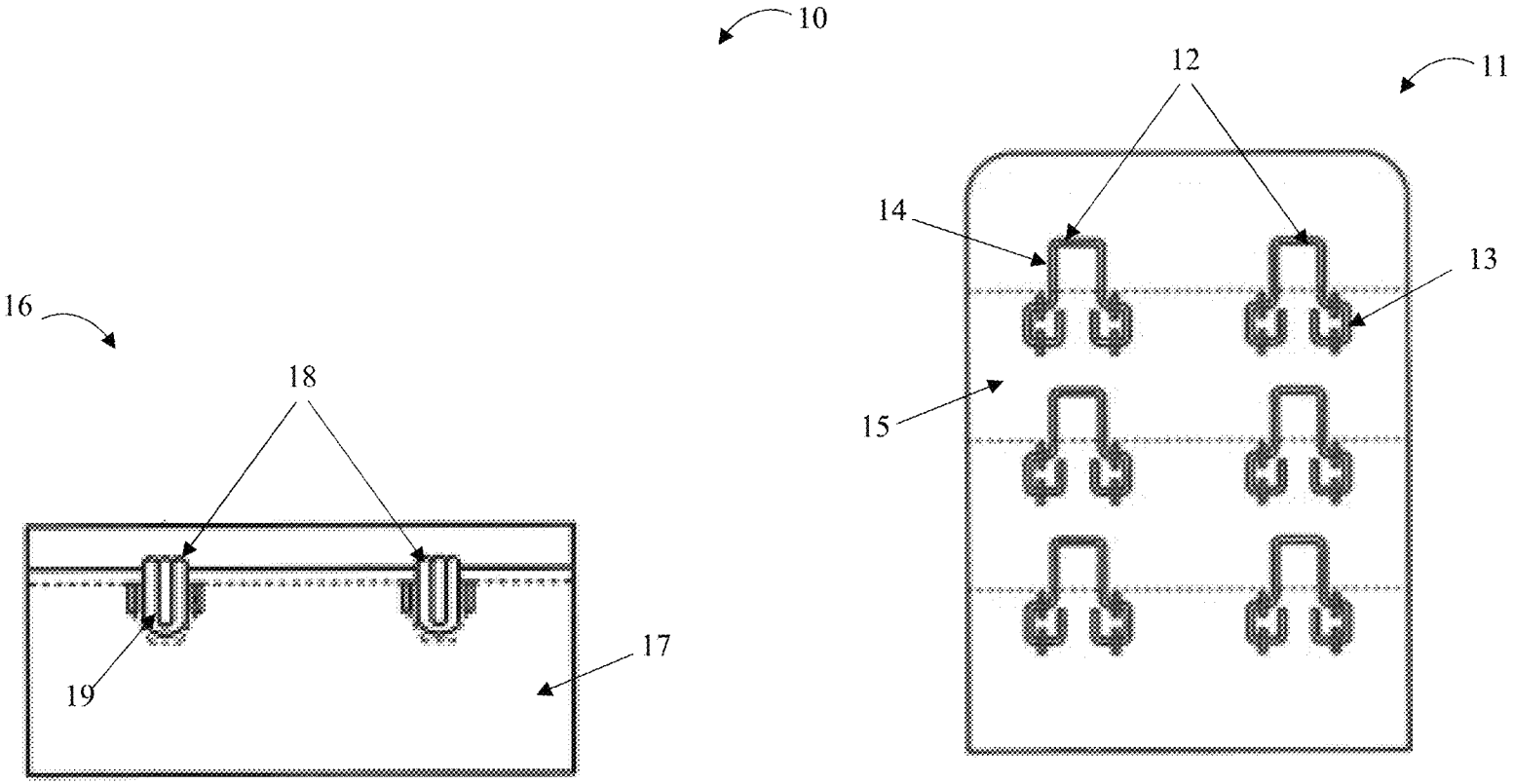
FIG. 1 is a top view of a hook and eye fastener of the prior art showing a pair of hooks and three pairs of eyes, each sewn to a fabric.
Figure 2:
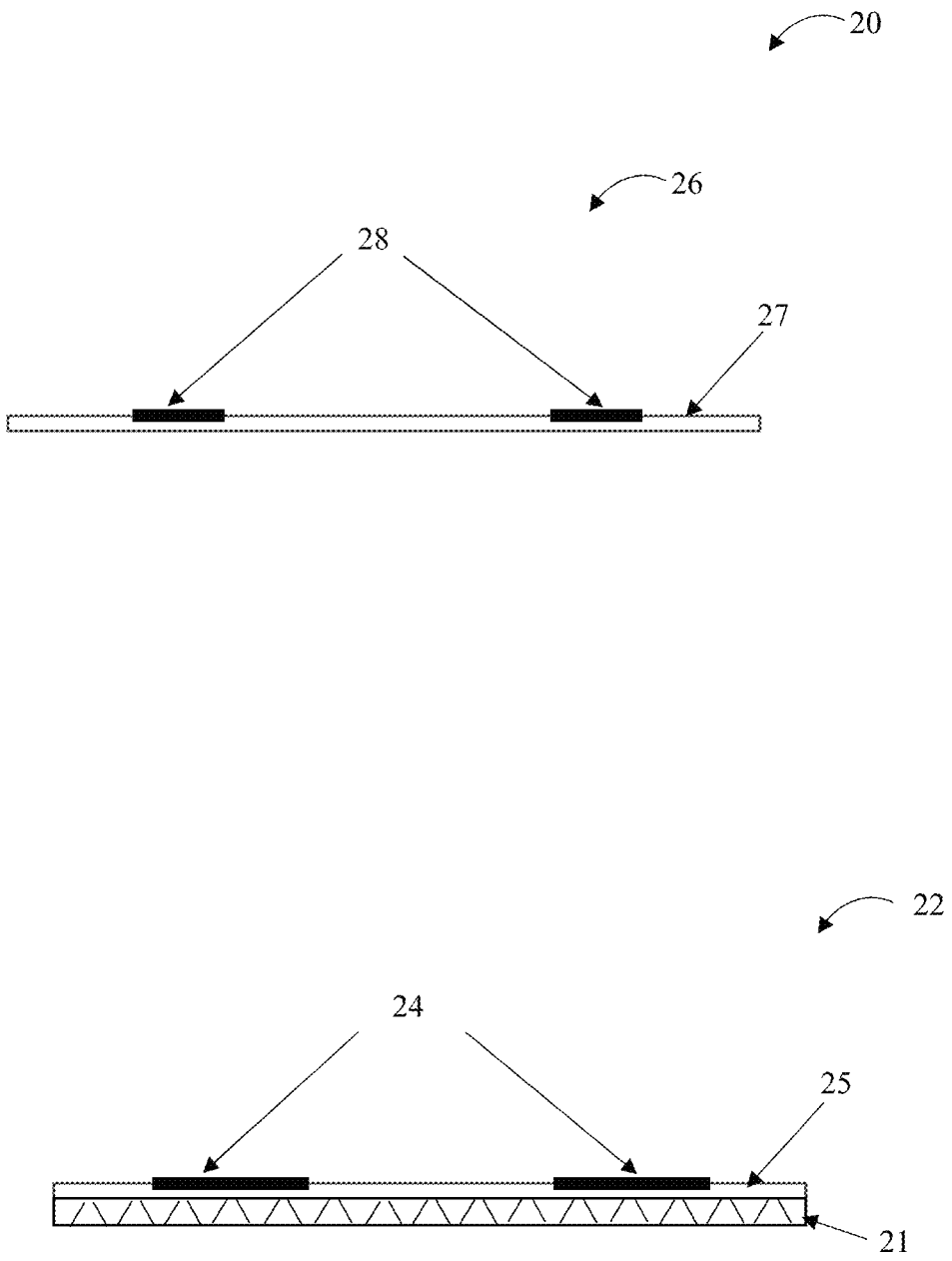
FIG. 2 is a schematic cross-sectional view of an example of a hook and eye fastener integrated with a fabric spacer.

FIG. 2 schematically illustrates an example of a fastener 20 that comprises a hook part 26 and an eye part 22. The eye part 22 and the hook part 26 comprise a number of eyelets 24 and hooks 28, that are secured to a respective tape 25 and 27. In the illustrated example, the hook part 26 is similar to the hook part 16 of FIG. 1. The eye part 22 further comprises a fabric spacer 21, such that the tape 25 with the eyelets 24 is bonded onto the fabric spacer. The edges of each of the eye part 22 and the hook part 26 are ultrasonically sealed. The eyelet 24 have a three-dimensional structure (more clearly shown on FIG. 3) with hoop 23 of the eyelet 24 raised away from a surface of the tape 25 (the body of the hoop 23 is angled with respect to the surface of the tape 25), such that it can be more easily engaged by the hooking end of the hook 28. As illustrated in FIGS. 2 and 3, the hook part 26 does not comprise a fabric spacer because in use the hook part 26 of the fastener 20 is on the outside of the garment, not facing the skin of the wearer, and therefore does not need cushioning. Both the hook 28 and the eyelet 24 can be made of any suitable metal or plastic. In one embodiment, the hook 28 and the eyelet 24 can be made of a non-magnetic metal, to pass the needle free test required in most garment factories.

Figure 4:
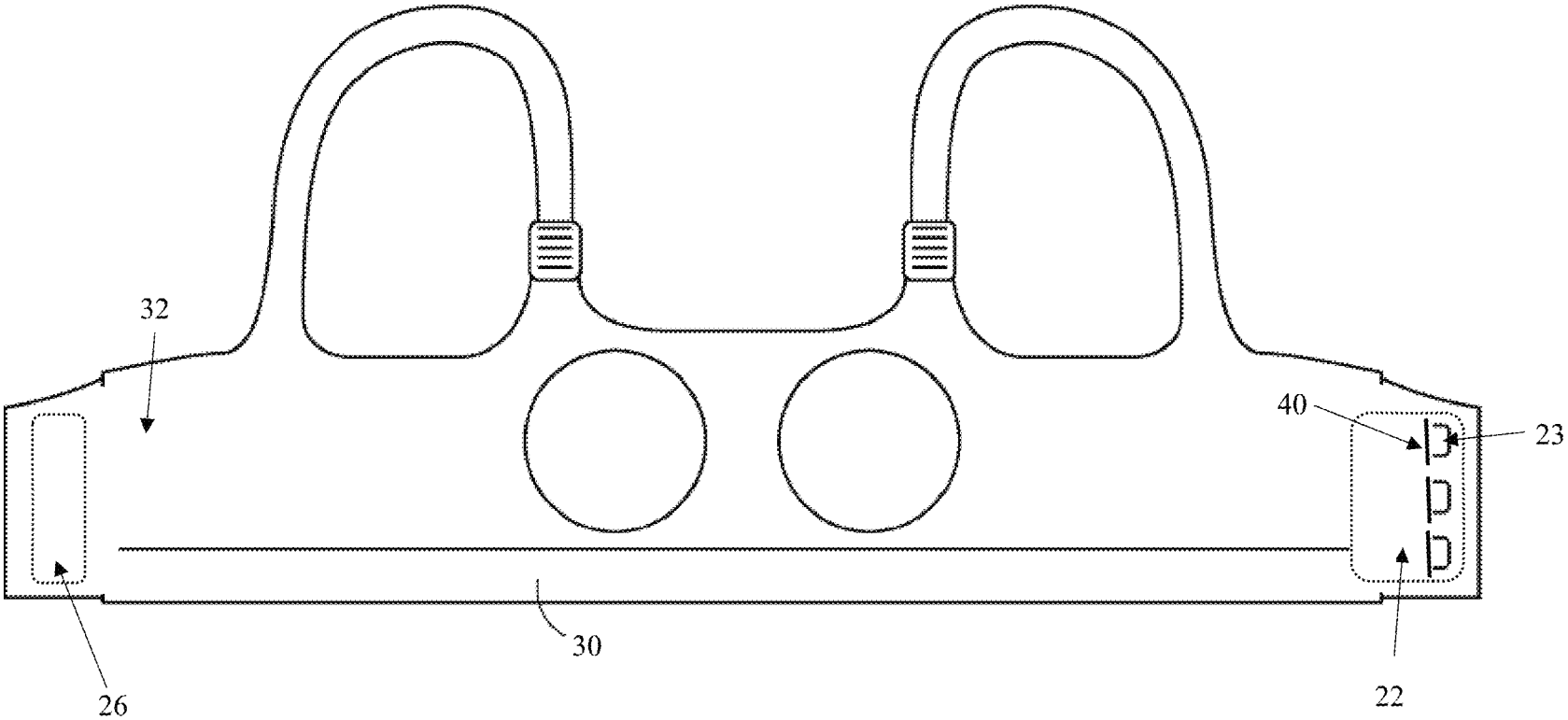
FIG. 4 is schematic top view of an outer side of a garment employing the fastener of FIG. 2.

The fastener 20 can be incorporated in a garment, such as, for example, a bra 30 illustrated in FIG. 4, which shows the top, outside, view of the bra, with the hook part 26 and the eye part 22 of the fastener 20 integrated therein. The hook part 26 and the eye part 22 of the fastener 20 can be concealed within a respective wing 32 of the bra 30. For example, each of the hook part 26 and the eye part 22 can be inserted between the outer and inner panels of the respective wing 32. A number of slits 40 are made into the respective inner and outer panels of the respective wing 32, so that a hooking end of the hook 28 and the loop 23 of the eyelet 24 can protrude out of the slits 40. FIG. 4 shows only slits 40 formed on the outer panel of the bra's left wing so that the angled body of the loop 23 of the eyelet 24 can protrude out of the slit; however, the person skilled in the art would understand that similar slits can be formed on the inner panel of the bra's right wing so that the hooking end of the hook can protrude out of the panel. The fastener 20 is lightweight (minimum fabric layers) and can be concealed within the panels of the garment 30 to provide a clean surface with no rough edges or opportunity to chafe the skin. The number of eyelets in one row or number of rows, as well as the number of the hooks, can be increased for further support and strength. The size of the fastener 20 can be changed to meet the end use. Persons skilled in the art understand that the eye part 22 and/or the hook part 26 can have more fabric layers bonded therein without departing from the scope of the invention.

The fastener 20 can be used in any other garment or accessory. It can be used in other areas of the lingerie, medical corsetry and physiotherapy applications or any other application where the garment or accessory is close to the body of the wearer, difficult to fasten and/or needs extra comfort, breathability, and/or flexibility, with no chaffing of skin.

While particular elements, embodiments and applications of the present disclosure have been shown and described, it will be understood, that the scope of the disclosure is not limited thereto, since modifications can be made by those skilled in the art without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways.

All possible combinations and subcombinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the inventions described herein.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

The invention claimed is:

1. A garment comprising a fastener, the fastener comprising: a first part having: at least one first fastening member having a base and a looping end; a first fabric having a first surface and a second surface, the base of the at least one first fastening member being secured to the second surface of the first fabric; and a fabric spacer, the first surface of the first fabric being bonded to a top surface of the fabric spacer, wherein the fabric spacer is a three-dimensional textile cushioning structure in which two outer fabric layers are knitted or woven with a spacer layer that extends therebetween as one cohesive fabric; and a second part having: at least one second fastening member having a base and a hooking end; a second fabric having a first surface and a second surface, the base of the at least one second fastening member being secured to be second surface of the second fabric, wherein the hooking end of the at least one second fastening member being configured to releasably engage the looping end of the at least one first fastening member to bring close together the first part and the second part of the fastener; further comprising an outer panel and an inner panel, wherein the first and the second parts of the fastener are concealed between the outer panel and the inner panel of the garment.

2. The garment of claim 1, wherein the looping end of the at least one first fastening member is angled in respect to the base such that the looping end extends away from the second surface of the first fabric.

3. The garment of claim 1, wherein edges of each of the first part and the second part are ultrasonically sealed.

4. The garment of claim 1, wherein the three-dimensional textile structure comprises a monofilament layer between the two outer fabric layers.

5. The garment of claim 1, wherein the fabric spacer comprises an anti-bacterial finishing.

6. The garment of claim 1, wherein the fabric spacer comprises a water resistant finishing.

* * * * *